US007100417B2

(12) United States Patent
Yamanaka et al.

(10) Patent No.: US 7,100,417 B2
(45) Date of Patent: Sep. 5, 2006

(54) LOWER DIE ASSEMBLY IN PRESSING MACHINE

(75) Inventors: Shigeaki Yamanaka, Hiroshima (JP); Takeshi Kazama, Hiroshima (JP)

(73) Assignee: Kubota Iron Works Co., Ltd., Hiroshima (JP)

( * ) Notice: Subject to any disclaimer, the term of this patent is extended or adjusted under 35 U.S.C. 154(b) by 167 days.

(21) Appl. No.: 10/713,167

(22) Filed: Nov. 13, 2003

(65) Prior Publication Data

US 2005/0103088 A1 May 19, 2005

(51) Int. Cl.
*B21J 13/00* (2006.01)

(52) U.S. Cl. ..... 72/448; 72/446; 72/481.6; 72/481.7

(58) Field of Classification Search ..... 72/481.1, 72/476, 481.2, 481.6, 481.7, 482.93, 448, 72/478, 481.8, 462; 483/28, 29
See application file for complete search history.

(56) References Cited

U.S. PATENT DOCUMENTS

| | | | | |
|---|---|---|---|---|
| 1,190,696 A | | 7/1916 | Wilzin | |
| 1,234,654 A | | 7/1917 | Gaynor | |
| 3,269,168 A | * | 8/1966 | Anderson | 72/412 |
| 3,673,908 A | * | 7/1972 | Smith | 83/685 |
| 4,301,673 A | * | 11/1981 | Yonezawa | 72/448 |
| 4,317,358 A | * | 3/1982 | Yonezawa et al. | 72/448 |
| 4,485,549 A | | 12/1984 | Brolund | |
| 4,958,966 A | | 9/1990 | Andrews | |
| 5,000,022 A | | 3/1991 | Shinkai et al. | |
| 5,613,693 A | | 3/1997 | Ramunas | |
| 6,134,938 A | * | 10/2000 | Ohtsuka | 72/328 |
| 2005/0103089 A1 | | 5/2005 | Yamanaka et al. | |

* cited by examiner

*Primary Examiner*—Derris H. Banks
*Assistant Examiner*—Teresa M. Bonk
(74) *Attorney, Agent, or Firm*—Frishauf, Holtz, Goodman & Chick, P.C.

(57) ABSTRACT

An improved lower die assembly is provided which allows a given lower die in a pressing machine to be replaced with another easily and in a short period of time relative to a die holder. In the lower die assembly in which a lower die is received and securely held in a die holder, the improvement comprises: a clamp means whereby the lower die when unclamped is received in the die holder so that the lower die can be extracted from the die holder upwards and then when clamped is securely held therein; and a lift means disposed below the lower die and whereby the lower die when unclamped is raised above an upper end of the die holder.

1 Claim, 1 Drawing Sheet

LOWER DIE ASSEMBLY IN PRESSING MACHINE

BACKGROUND OF THE INVENTION

1. Field of the Invention

The present invention relates to a lower die assembly for use in a pressing machine.

2. Description of the Prior Art

In a pressing machine, especially for cold forging, a lower die or die set is typically received in a die holder anchored to a bolster.

The conventional lower die arrangement has had a design such that a lower die set is received and securely held in the die holder that can be decomposed into a plurality of holder segments. When the die set is taken out of the die holder for the alteration of a formed product, it has been necessary to unclamp the die set from the die holder and then to hang and move one by one die members that make up the die set with a chain hoist or the like.

Consequently, it has been time-consuming to change die sets each having a plurality of die members from one to another, and it has also been laborious and cumbersome to set about such a requirement.

BRIEF SUMMARY OF THE INVENTION

With the forgoing taken into account, the present invention has an object aimed at providing an improved lower die assembly for use in a pressing machine, which allows a lower die or die set (hereinafter referred to simply as "lower die") to be replaced with another easily and in a short period of time relative to a die holder when a lower die rearrangement is required such as when a formed product is to be altered by another.

In order to achieve the object mentioned above, there is provided in accordance with the present invention a lower die assembly for use in a pressing machine, in which a lower die is received and securely held in a die holder, characterized in that it comprises: a clamp means whereby the lower die when unclamped is received in the die holder so that the lower die can be extracted from the die holder upwards and then when clamped is securely held therein; and a lift means disposed below the lower die and whereby the lower die when unclamped is raised above an upper end of the die holder.

With the lower die assembly configured as mentioned above, the lower die is inserted from above the die holder into and accepted in the die holder and then securely held therein by the clamp means. In taking the lower die out, the clamp means is released and the lift means is actuated to raise the lower die until its lower face lies higher in position than the upper end face of the die holder, after which the lower die is moved horizontally so that it can be taken out of the pressing machine.

BRIEF DESCRIPTION OF THE DRAWINGS

These and other objects, features and advantages of the present invention and other manners of its implementation will be more readily apparent, and the invention itself will also be better understood, from the following detailed description when taken with reference to the drawings attached hereto showing certain illustrative forms of implementation of the present invention. In the drawings, the sole Figure is a cross sectional view illustrating one form of implementation of the present invention.

DETAILED DESCRIPTION

Figure 1:
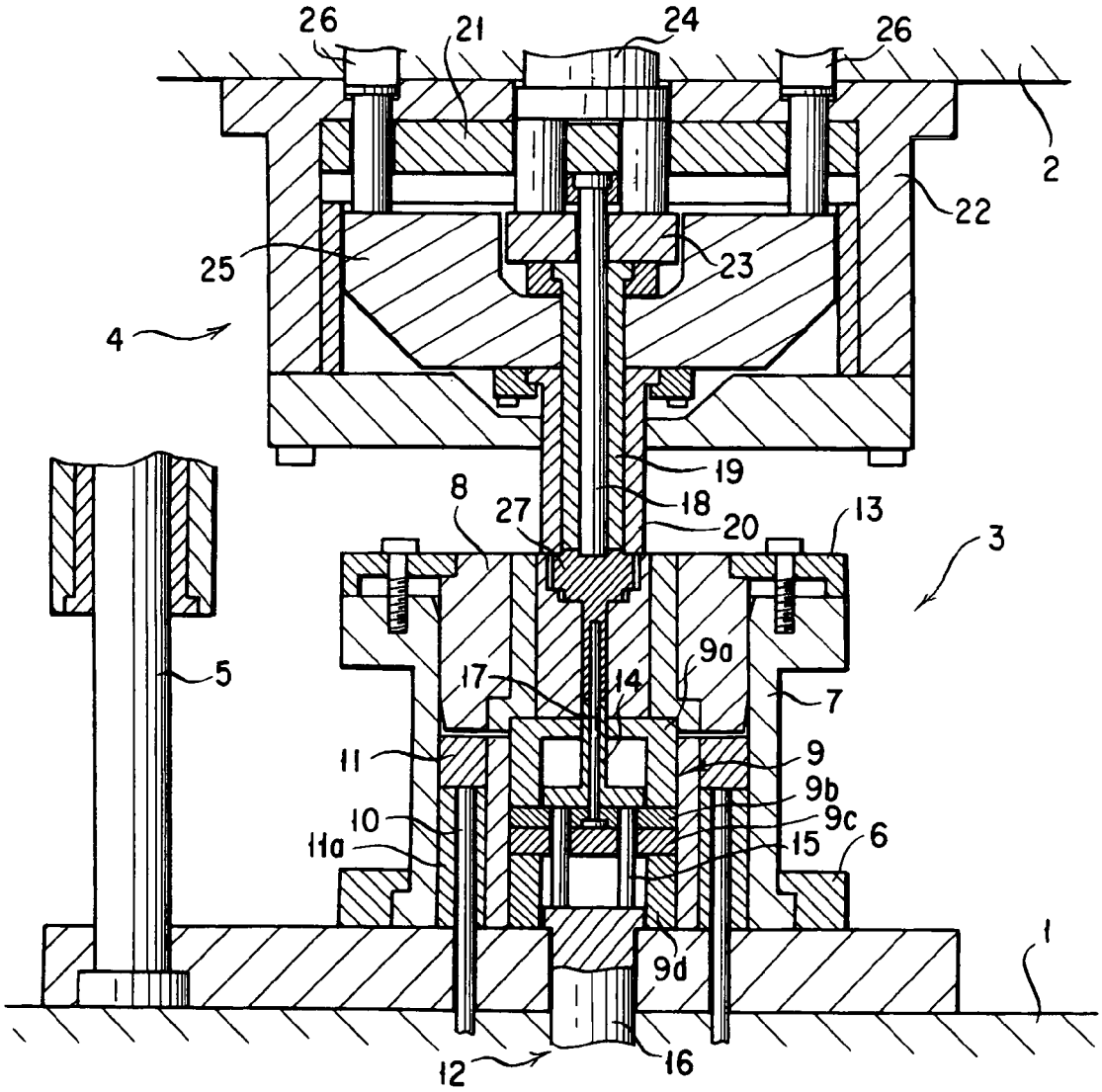
FIG. 1 is a sectional view illustrating a form of implementation of the present invention.

An explanation is now given of a form of implementation of the present invention with reference to the Drawing Figure. In the Figure there are shown a bolster 1, a slide 2, a lower die assembly or unit 3 fastened to an upper surface of the bolster 1, an upper die assembly or unit 4 fastened to a lower surface of the slide 2, and a guide post 5 for guiding the upper die unit 4 vertically up and down relative to the lower die unit 3.

The lower die unit 3 as shown comprises a die holder 7 fastened to the bolster 1 by means of a fastening member 6, a lower die 8 received in the die holder 7 slidably up an down to be tight-fitted therein, a set pedestal 9 for setting the lower die 8 at a predetermined height in the die holder 7, a lifting plate 11 supported on a stand 11*a* to 11*e* opposed to the lower surface of the lower die 8, a lower part forming unit 12 disposed inside of the set pedestal 9 beneath the lower die 8 and which closes the lower side of a lower die cavity of the lower die 8, and a clamp means 13 for clamping the lower die 8 to the die holder 7. The lifting plate 11 is adapted here to be raised by lifting rods 10. The clamp means 13 may comprise a plurality of clamp members disposed at a plurality of locations, respectively, circumferentially of the die holder 7. The set pedestal 9 as shown is made of a ring plate 9*a*, a mandrel plate 9*b*, a plain plate 9*c* and a ring plate 9*d*. To clamp the lower die 8 to the die holder 7, the clamp means 13 may be actuated manually or by means of an oil hydraulic cylinder or any other known suitable means.

A said lifting rod 10 is operatively coupled to a lower die lift cylinder not shown. The lower part forming unit 12 comprises a lower part forming die 14 inserted through a lower part of the die cavity of the lower die 8 in a slide fit therewith and supported by the set pedestal 9, and a hollow part forming pin 17 that passes through the lower part forming die 14, wherein the lower part forming die 14 is adapted to be lifted up and down by a lower part forming cylinder not shown with the intermediary of rods 15 and a lower supporting block 16, and the hollow part forming pin 17 is supported from the set pedestal 9.

The lower die 8 is formed in a multi-layer structure made of a plurality of die members together so that if a lower die member is worn thin in its inside in which the lower die cavity is formed the inside can be replaced.

The upper die unit 4 includes a main punch 18 formed in the shape of a shaft, an inner punch 19 formed in the shape of a cylinder such as to surround the main punch 18, and an outer punch 20 formed in the shape of a cylinder such as to surround the inner punch 19. These punches 18, 19 and 20 are slidably fitted one in another. Further, the main punch 18 is united with the slide 2 via a plate 21 and a frame member 22, the inner punch 19 is coupled via an intermediate member 23 to a piston rod of an inner cylinder 24 provided for the slide 2, and the outer punch 20 is coupled via another intermediate member 25 to respective piston rods of outer cylinders 26 and 26 for the slide 2 parallel to the inner cylinder 24.

In the lower die unit 3 with its makeup mentioned above, the lower die 8 is slidably inserted into and fitted with the die holder 7 and thereafter securely held therein by fastening the clamp means 13 thereto.

In this state, a formable material 27 is inserted into the die cavity of the lower die 8 and loaded in a slide fit therewith.

Thereafter, the slide 2 is moved down to press an upper part of the material 27 with the main, inner and outer punches 18, 19 and 20 and thereby to form the material 27 into a shape complementary to that of the die cavity of the lower die 8.

Then, the lower part forming die 14 of the lower part forming unit 12 in the lower die unit 3 is moved up with the lower part forming cylinder to form a lower part of the material into a given shape.

A product formed as mentioned above is then knocked out by raising the lower part forming die 14 in the lower part forming unit 12.

A lower die 8 in the lower die unit 3 needs to be exchanged when it is worn and when its formed product is altered, in a manner as mentioned below.

Referring to the FIG. 1, the clamp means 13 is unfastened and detached to release clamping of the lower die 8 to the die holder 13. Then, the lifting rods 10 are raised to raise the lifting plate 11 on their upper ends and thereby to vertically raise the lower die 8 until its lower end lies higher in position than the upper end of the die holder 7. Then, the lower die 8 for removal from the pressing machine is moved horizontally and placed on a table prepared beside it. For setting a new lower die 8 in the die holder 7, a way reverse to the take-out way mentioned above may be followed.

According to the present invention, a lower die 8 in a lower die unit 3 can be extracted upwards from a die holder 7 simply by unfastening and detaching a clamp means 13 from the die holder 7 and then raising a lifting plate 11. Accordingly, the lower die 8 that may be large in weight can readily be taken out of the die holder 7. This in turn permits a lower die resetting to be performed easily and in a short period of time as it is required such as in the alteration of formed products.

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences of scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

What is claimed is:

1. A lower die assembly for a pressing machine for cold forging, said lower die assembly comprising:

a lower die which is formed in a multi-layer structure comprising a plurality of die members together;

a die holder for receiving and securely holding the lower die;

a clamp mechanism for securely clamping the lower die in the die holder, wherein when the lower die is unclamped the lower die is held in the die holder so as to be extractable upwards from the die holder; and a lift mechanism including a lifting plate which is disposed below the lower die and a lifting rod which is operatively coupled to a lower die lift cylinder and which is operable to raise the lower die above an upper end of the die holder via the lifting plate when the lower die is unclamped.

* * * * *